US008339334B2

(12) United States Patent
Byeon

(10) Patent No.: US 8,339,334 B2
(45) Date of Patent: Dec. 25, 2012

(54) PLASMA DISPLAY PANEL DRIVING CIRCUIT AND DRIVING METHOD

(75) Inventor: Jae-il Byeon, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 957 days.

(21) Appl. No.: 12/402,034

(22) Filed: Mar. 11, 2009

(65) Prior Publication Data

US 2009/0256828 A1 Oct. 15, 2009

(30) Foreign Application Priority Data

Apr. 14, 2008 (KR) ..... 10-2008-0034210

(51) Int. Cl.
*G09G 5/00* (2006.01)
*G09G 3/28* (2006.01)

(52) U.S. Cl. ..... 345/62; 345/68

(58) Field of Classification Search ..... 345/60–72, 345/690–693; 315/169.4
See application file for complete search history.

(56) References Cited

U.S. PATENT DOCUMENTS

2005/0116886 A1* 6/2005 Jeong et al. ..... 345/60
2007/0069983 A1* 3/2007 Choi ..... 345/60
2007/0097027 A1* 5/2007 Moon ..... 345/60
2007/0126658 A1* 6/2007 Han et al. ..... 345/60
2007/0222709 A1* 9/2007 Park et al. ..... 345/60

FOREIGN PATENT DOCUMENTS

| | | |
|---|---|---|
| JP | 11-316572 | 11/1999 |
| KR | 1020010084381 | 9/2001 |
| KR | 1020020032927 | 5/2002 |
| KR | 1020050023773 | 3/2005 |

OTHER PUBLICATIONS

English Abstract for Publication No. 11-316572.
English Abstract for Publication No. 1020010084381.
English Abstract for Publication No. 1020020032927.
English Abstract for Publication No. 1020050023773.

* cited by examiner

*Primary Examiner* — Hoa T Nguyen
*Assistant Examiner* — Andrew Sasinowski
(74) *Attorney, Agent, or Firm* — F. Chau & Associates, LLC

(57) ABSTRACT

A driving circuit of a data electrode is provided which includes a drive controlling unit, a first driving transistor and a second driving transistor. The drive controlling unit compares a previous data signal and a present data signal in response to an energy recovery enable signal and outputs a first driving signal and a second driving signal, which correspond to the comparison result. The first driving transistor transmits an address driving signal to an output node connected to the data electrode in response to the first driving signal. The second driving transistor transmits a reference voltage to the output node in response to the second driving signal.

15 Claims, 11 Drawing Sheets

FIG. 5

| ENerc | High | | | | Low | | | |
|---|---|---|---|---|---|---|---|---|
| Data 1 | High | | Low | | High | | Low | |
| Data 2 | High | Low | High | Low | High | Low | High | Low |
| PD (PM) | High (Off) | Low (On) | Low (On) | High (Off) | Low (On) | Low (On) | High (Off) | High (Off) |
| ND (NM) | Low (Off) | Low (Off) | Low (Off) | High (On) | Low (Off) | Low (Off) | High (On) | High (On) |
| V_Dm | Hi-z | rising | falling | Vg | Va | Va | Vg | Vg |
| | A | B | C | D | E | F | G | H |

PLASMA DISPLAY PANEL DRIVING CIRCUIT AND DRIVING METHOD

CROSS-REFERENCE TO RELATED APPLICATION

This application claims priority to and the benefit of Korean Patent Application No. 10-2008-0034210, filed on Apr. 14, 2008, in the Korean Intellectual Property Office, the entire content of which is incorporated herein by reference.

BACKGROUND

The present invention relates to plasma display panels (PDPs), and, more particularly, to a driving circuit and a driving method of a PDP.

A PDP is a display panel suitable for middle/large-sized displays. As the size of the PDP is increased, its power consumption increases. Thus, for product efficiency reasons, a need exists to reduce the power consumption of middle/large-sized displays.

FIG. 1 illustrates a conventional PDP 100. The conventional PDP 100 includes M data electrodes D1 through DM, N scan electrodes Y1 through YN, N sustain electrodes X1 through XN, and discharge cells C11 through CNM arranged in N rows and M columns. A voltage for driving the conventional PDP 100 is applied to a discharge cell which is formed at intersections between the electrodes. For example, a data electrode driving voltage, a scan electrode driving voltage and a sustain electrode driving voltage are applied to the discharge cell C11 through the data electrode D1, the scan electrode Y1 and the sustain electrode X1, respectively.

The discharge cells C11 through CNM in N rows and M columns correspond to pixels in N rows and M columns, respectively. In the pixels in N rows and M columns, to select the pixel in an $n_{th}$ (n being in the range of 1 to N) row and an $m_{th}$ (m being in the range of 1 to M) column, the scan electrode driving voltage including a scan voltage is applied to the discharge cell Cnm through the scan electrode Yn, and the data electrode driving voltage including an address voltage is applied to the discharge cell Cnm through the data electrode Dm. The selection of the discharge cells C11 through CNM will now be described with reference to FIG. 2.

FIG. 2 illustrates data electrode driving voltages V_D1, V_D2, V_D3 and V_D4 for respectively driving data electrodes D1, D2, D3 and D4 illustrated in FIG. 1. In FIG. 2, an address period for selecting specific discharge cells from among driving periods of a PDP is illustrated.

The data electrode driving voltage V_D1 is for driving the data electrode D1. As illustrated in FIG. 2, an address voltage Va is applied to the discharge cell C11, the discharge cell C21 and the discharge cell C41, and a reference voltage Vg is applied to the discharge cell C31 and the discharge cell C51. In this case, as illustrated in FIG. 1, in the address period, the discharge cell C11, the discharge cell C21 and the discharge cell C41 are selected, and the discharge cell 31 and the discharge cell 51 are not selected. In this regard, a data sequence "1, 1, 0, 1 and 0" is sequentially transferred to the discharge cells "C11, C21, C31, C41 and C51" through the data electrode D1.

With the data electrode driving voltage V_D2 for driving the data electrode D2, the discharge cell C12, the discharge cell C22, the discharge cell C32 and the discharge cell C52 are selected, and the discharge cell C42 is not selected. With the data electrode driving voltage V_D3 for driving the data electrode D3, the discharge cell C23, the discharge cell C33 and the discharge cell C43 are selected, and the discharge cell C13 and the discharge cell C53 are not selected. With the data electrode driving voltage V_D4 for driving the data electrode D4, the discharge cell C24, the discharge cell C44 and the discharge cell C54 are selected, and the discharge cell C14 and the discharge cell C34 are not selected.

As illustrated in FIG. 2, in the address period, since the data electrode driving voltages V_D1, V_D2, V_D3 and V_D4 which swing between the address voltage Va and the reference voltage Vg need to be applied to the data electrodes D1, D2, D3 and D4, a large amount of power is consumed. As power consumption is increased, thermal issues, together with increased energy consumption, occur.

SUMMARY

Exemplary embodiments of the present invention provide a driving circuit and a driving method of a PDP in which a data electrode is driven according to a comparison result between a previous data signal and a present data signal such that unnecessary energy consumption is reduced.

According to an exemplary embodiment, there is provided a driving circuit of a PDP having a data electrode, the driving circuit having a drive controlling unit that compares a previous data signal and a present data signal in response to an energy recovery enable signal, and that outputs a first driving signal and a second driving signal which correspond to a comparison result; a first driving transistor which transmits an address driving signal to an output node connected to the data electrode in response to the first driving signal; and a second driving transistor which transmits a reference voltage to the output node in response to the second driving signal.

When a logic level of the previous data signal is high and a logic level of the present data signal is high, the first driving transistor may be turned off during a period in which the energy recovery enable signal is enabled.

When the logic level of the previous data signal is high and the logic level of the present data signal is high, the second driving transistor may be turned off during a period in which the energy recovery enable signal is enabled.

When a logic level of the previous data signal is low and a logic level of the present data signal is low, the first driving transistor may be turned off during a period in which the energy recovery enable signal is enabled.

When the logic level of the previous data signal is low and the logic level of the present data signal is low, the second driving transistor may be turned on during a period in which the energy recovery enable signal is enabled.

When a logic level of the previous data signal is different from a logic level of the present data signal, the first driving transistor may be turned on and the second driving transistor is turned off during a period in which the energy recovery enable signal is enabled.

The address driving signal may be maintained at an address voltage during a period in which the energy recovery enable signal is disabled, and the address driving signal may fall from the address voltage or rises to the address voltage during a period in which the energy recovery enable signal is enabled.

The drive controlling unit may include a comparison unit that compares the previous data signal and the present data signal in response to the energy recovery enable signal, and that outputs a drive controlling signal and the second driving signal which correspond to the comparison result; and a level shifter which shifts a voltage level of the drive controlling signal and outputs the shifted drive controlling signal as the first driving signal.

The level shifter may include: a first p-type transistor having an input terminal connected to a fixed power voltage, an output terminal connected to a first node and a controlling terminal connected to a second node; a second p-type transistor having an input terminal connected to the fixed power voltage, an output terminal connected to the second node and a controlling terminal connected to the first node; a first n-type transistor having an input terminal connected to the first node, an output terminal connected to a reference voltage and a controlling terminal receiving the drive controlling signal; a second n-type transistor having an input terminal connected to the second node and an output terminal connected to the reference voltage; and an inverter inverting a logic level of the drive controlling signal and outputting the inverted drive controlling signal to a controlling terminal of the second n-type transistor.

The first driving transistor may be a p-type metal oxide semiconductor field-effect transistor. The first driving transistor may comprise: an input terminal receiving the address driving signal; an output terminal connected to the output node; a controlling terminal receiving the first driving signal; and a body terminal connected to a fixed power voltage.

When a charge leakage path is formed from the output node to a reference voltage through a p-type parasitic transistor having an input terminal connected to the output node and an output terminal connected to the reference voltage, the fixed power voltage may be applied to a controlling terminal of the p-type parasitic transistor.

According to another exemplary embodiment, there is provided a method of driving a data electrode connected to a first discharge cell through an $N_{th}$ discharge cell in a PDP, the method comprising dividing an address period for selecting the first discharge cell through the $N_{th}$ discharge cell into data applying periods (a first data applying period through an $N_{th}$ data applying period) and energy recovery periods; applying an address voltage or a reference voltage to the data electrode in response to a logic level of an $n_{th}$ (n is a natural number in the range of 1 to N−1) data signal for an $n_{th}$ discharge cell in an $n_{th}$ data applying period; applying the address voltage or the reference voltage to the data electrode in response to a logic level of an $n+1_{th}$ data signal for an $n+1_{th}$ discharge cell in an $n+1_{th}$ data applying period; and isolating or connecting the data electrode from or to an energy recovery circuit in response to a comparison result between the $n_{th}$ data signal and the $n+1_{th}$ data signal in an energy recovery period between the $n_{th}$ data applying period and the $n+1_{th}$ data applying period.

When a logic level of the $n_{th}$ data signal is high and a logic level of the $n+1_{th}$ data signal is high, the data electrode may be isolated from the energy recovery circuit, in the energy recovery period between the $n_{th}$ data applying period and the $n+1_{th}$ data applying period.

When a logic level of the $n_{th}$ data signal is low and a logic level of the $n+1_{th}$ data signal is low, the data electrode may be isolated from the energy recovery circuit, in the energy recover period between the $n_{th}$ data applying period and the $n+1_{th}$ data applying period.

When a logic level of the $n_{th}$ data signal is different from a logic level of the $n+1_{th}$ data signal, the data electrode may be connected to the energy recovery circuit, in the energy recovery period between the $n_{th}$ data applying period and the $n+1_{th}$ data applying period.

BRIEF DESCRIPTION OF THE DRAWINGS

Exemplary embodiments of the present invention will be more clearly understood from the following detailed description taken in conjunction with the accompanying drawings in which:

FIG. 5 illustrates a data electrode driving voltage according to a logic level of a signal illustrated in FIG. 4;

DETAILED DESCRIPTION

Figure 1:
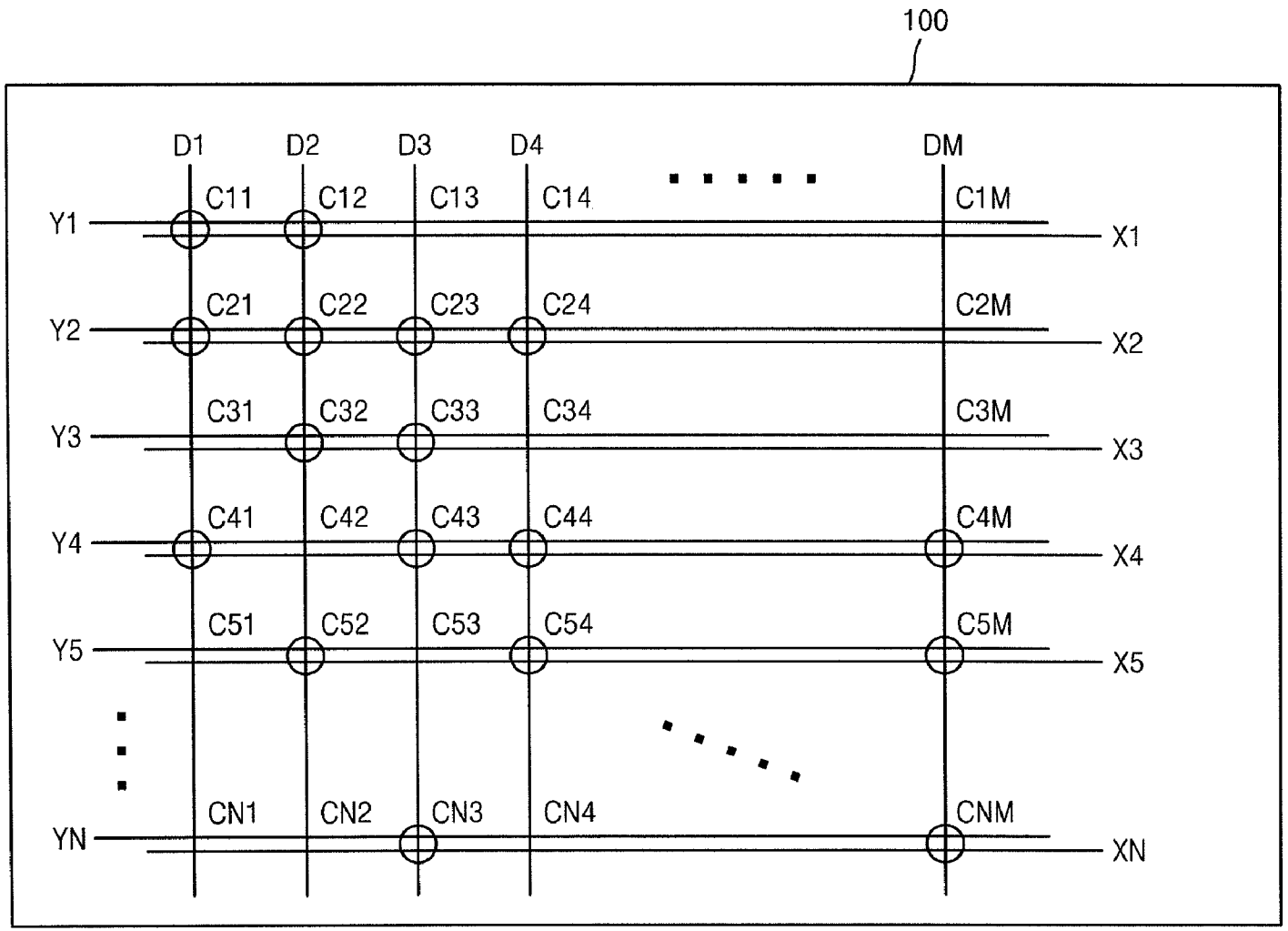
FIG. 1 (RELATED ART)
FIG. 1 illustrates a conventional PDP.
Figure 2:
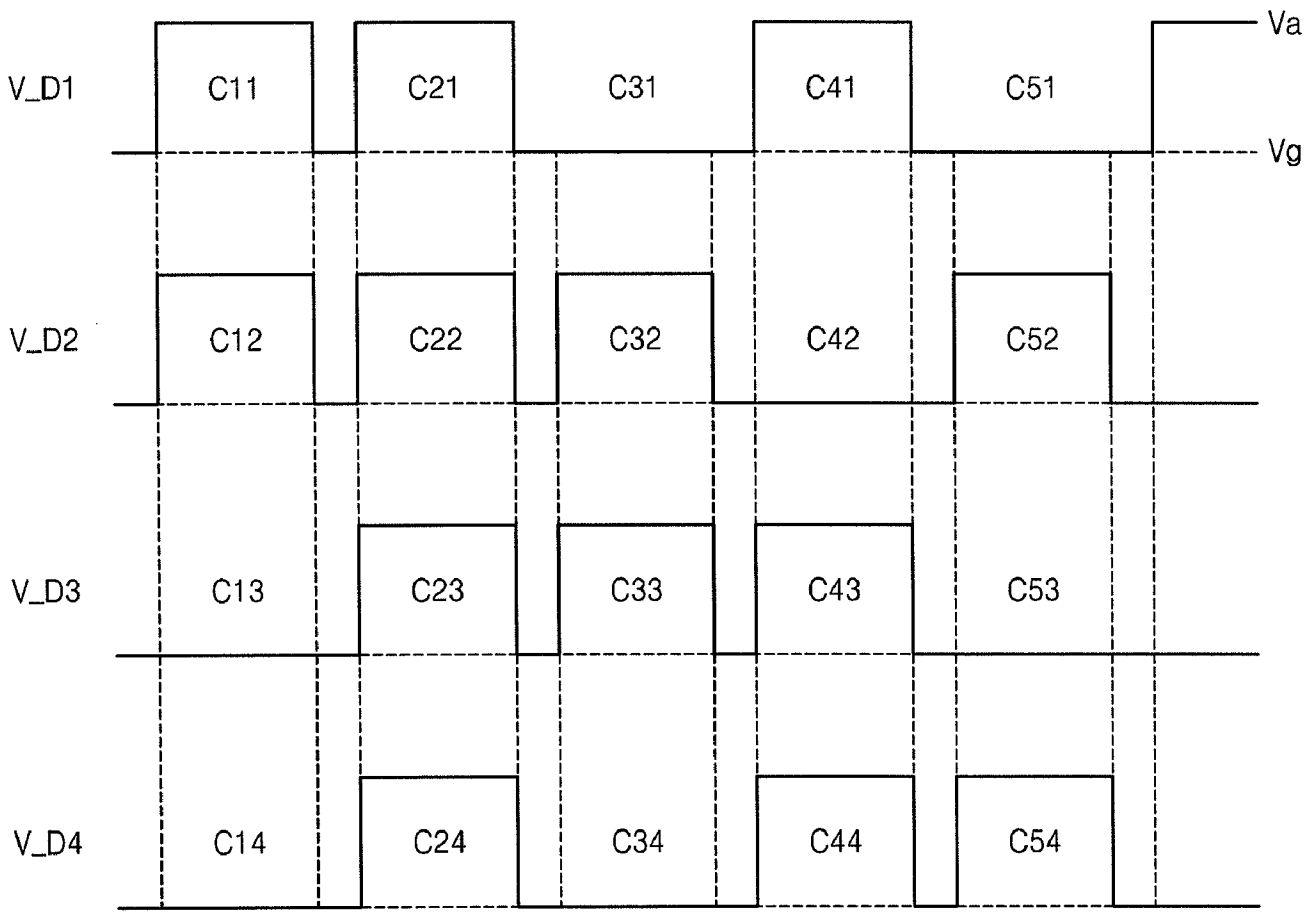
FIG. 2 (RELATED ART)
FIG. 2 illustrates data electrode driving voltages for driving data electrodes illustrated in FIG. 1.
Figure 3A:
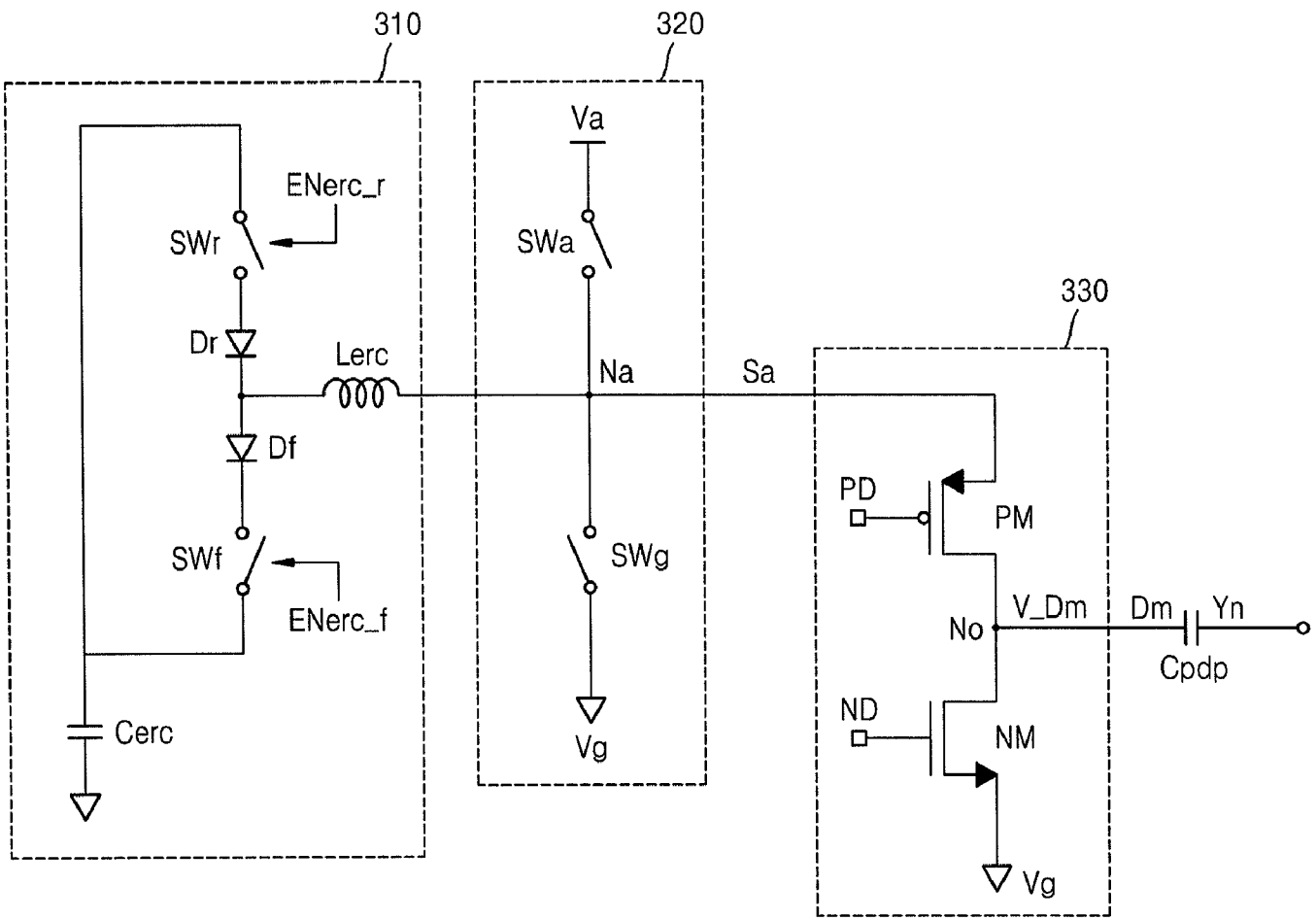
FIG. 3A illustrates a driving circuit of a data electrode including an energy recovery circuit.

Referring now to the driving circuit of FIG. 3A, the energy recovery circuit (ERC) 310, a voltage applying unit 320 and a data electrode driving unit 330 are illustrated. The ERC 310 includes a storage capacitor Cerc, a resonance inductor Lerc, a falling switch SWf responding to the energy recovery enable signal ENerc_f, a rising switch SWr responding to the energy recovery enable signal ENerc_r, a falling diode Df and a rising diode Dr. The voltage applying unit 320 includes an address voltage switch SWa for transmitting an address voltage Va to a node Na, and a reference voltage switch SWg for transmitting a reference voltage Vg to the node Na. The data electrode driving unit 330 includes a first driving transistor PM transmitting an address driving signal Sa to an output node No in response to a first driving signal PD, and a second driving transistor NM transmitting the reference voltage Vg to the output node No in response to a second driving signal ND. A data electrode driving voltage V_Dm output by the output node No is applied to a data electrode Dm. A discharge cell Cnm formed at an intersection between the data electrode Dm and a scan electrode Yn may be modeled as a panel capacitor Cpdp.

Figure 3B:
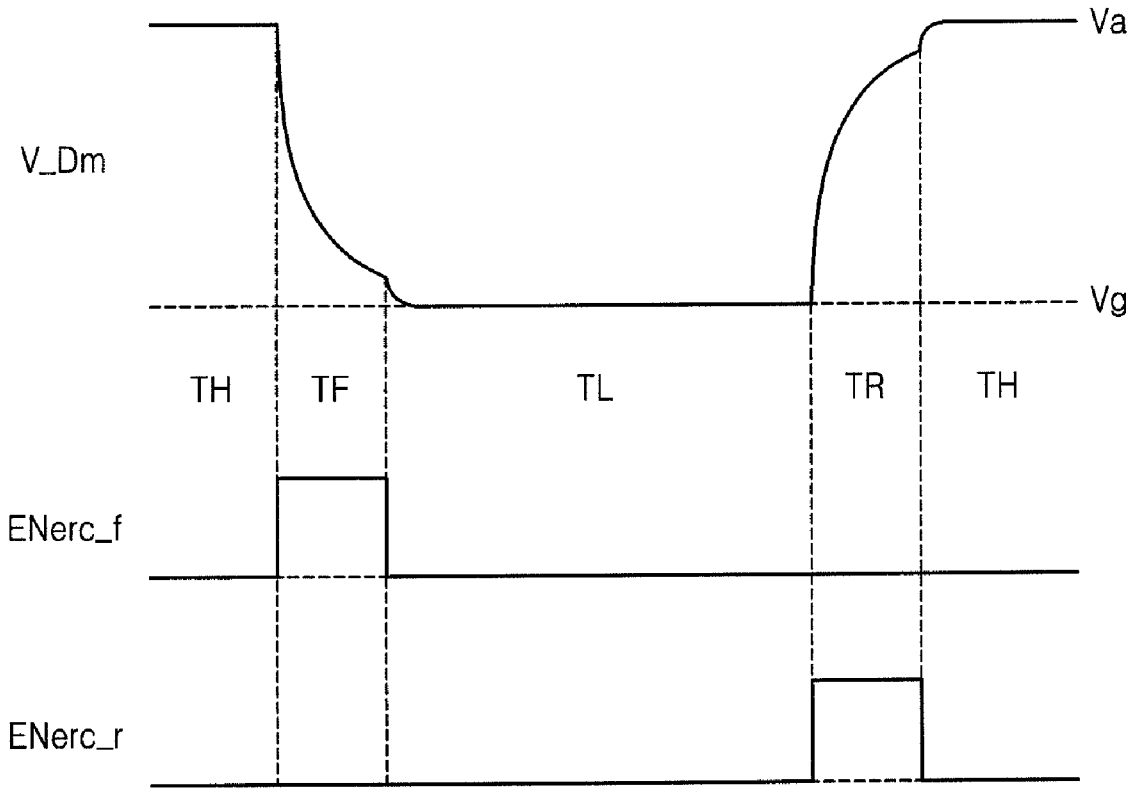
FIG. 3B is a graph for illustrating data electrode driving voltage and energy recovery enable signals, which are illustrated in FIG. 3A.

In a data applying period TH, as illustrated in FIG. 3B, the falling switch SWf, the rising switch SWr, the reference voltage switch SWg and the second driving transistor NM are turned off, and the address voltage switch SWa and the first driving transistor PM are turned on. In the data applying period TH in which both the energy recovery enable signal ENerc_f and the energy recovery enable signal ENerc_r are disabled, the address voltage Va is applied as the data electrode driving voltage V_Dm to the data electrode Dm.

In an energy recovery period TF, as illustrated in FIG. 3B, the rising switch SWr, the address voltage switch SWa, the reference voltage switch SWg and the second driving transistor NM are turned off, and the falling switch SWf and the first driving transistor PM are turned on. Thus, in the energy recovery period TF in which the energy recovery enable signal ENerc_f is enabled, a voltage falling from the address voltage Va is applied to the data electrode Dm. In the energy recovery period TF, electric charges accumulated in the panel capacitor Cpdp are sequentially moved to the storage capacitor Cerc through the first driving transistor PM, the resonance inductor Lerc, the falling diode Df and the falling switch SWf.

In a data applying period TL, as illustrated in FIG. 3B, the falling switch SWf, the rising switch SWr, the address voltage switch SWa, and the second driving transistor NM are tuned off, and the reference voltage switch SWg and the first driving transistor PM are turned on. Thus, in the data applying period TL in which both the energy recovery enable signal ENerc_f and the energy recovery enable signal ENerc_r are disabled, the reference voltage Vg is applied as the data electrode driving voltage V_Dm to the data electrode Dm. When the second driving transistor NM is turned on instead of the reference voltage switch SWg, the reference voltage Vg may be applied to the data electrode Dm.

In an energy recovery period TR, as illustrated in FIG. 3B, the falling switch SWf, the address voltage switch SWa, the reference voltage switch SWg and the second driving transistor NM are turned off, and the rising switch SWr and the first driving transistor PM are turned on. Thus, in the energy recovery period TR in which the energy recovery enable signal ENerc_r is enabled, a voltage rising to the address voltage Va is applied to the data electrode Dm. In the energy recovery period TR, electric charges accumulated in the storage capacitor Cerc are substantially moved to the panel capacitor Cpdp through the rising switch SWr, the rising diode Dr, the resonance inductor Lerc and the first driving transistor PM.

Figure 4:
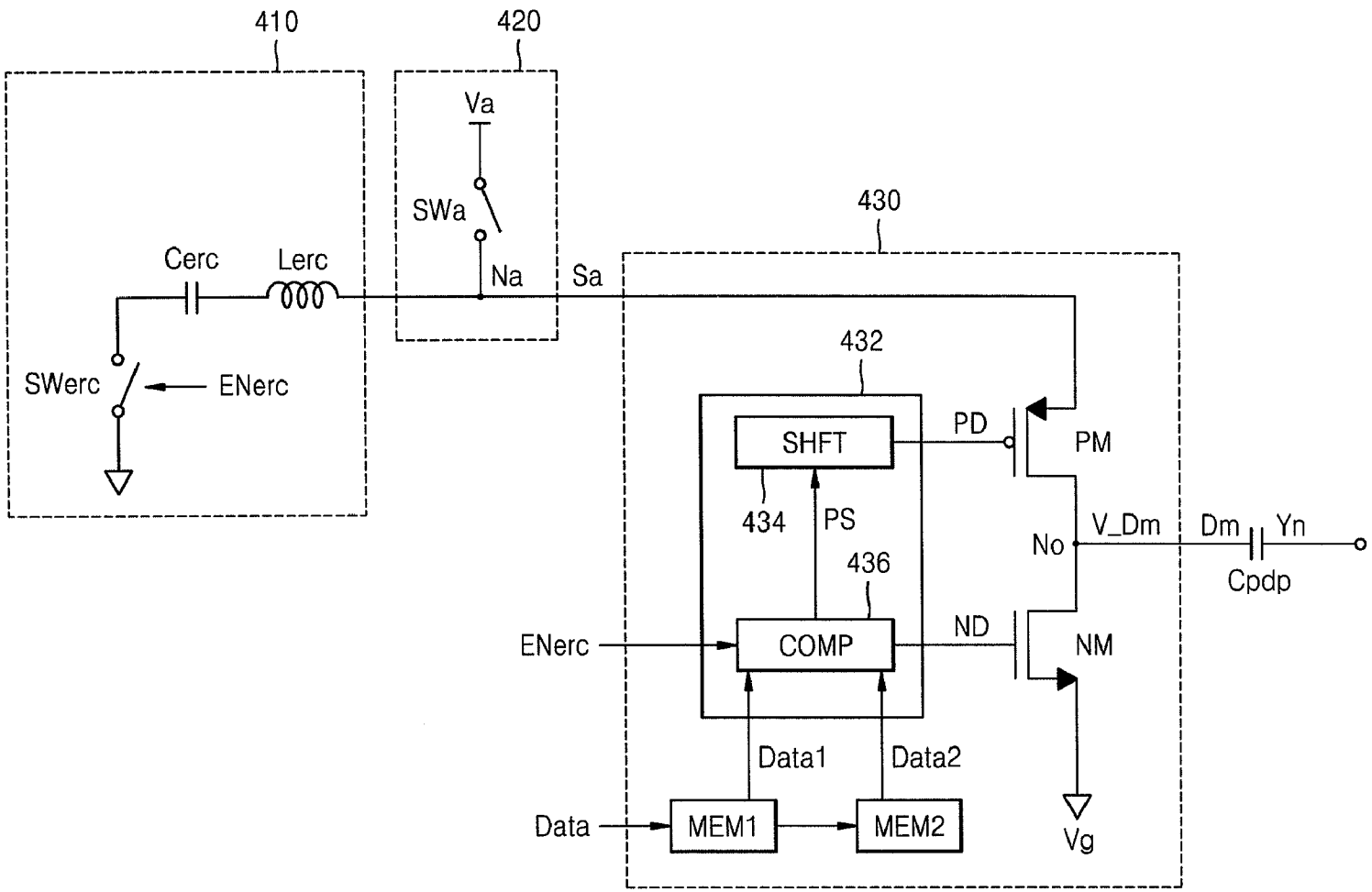
FIG. 4 illustrates a driving circuit of a data electrode according to an exemplary embodiment of the present invention.
Figure 6:
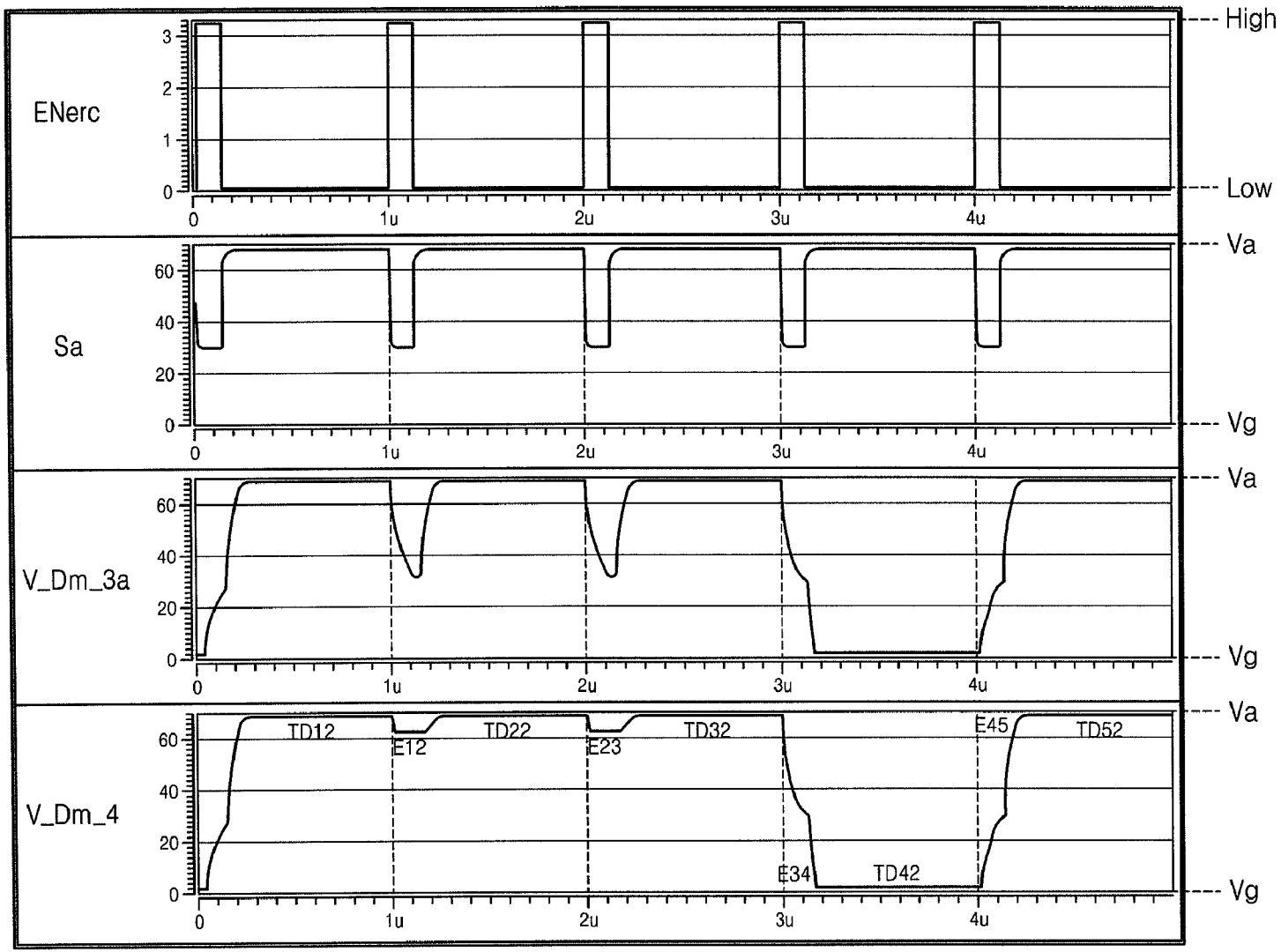
FIG. 6 illustrates an energy recovery enable signal, an address driving signal and the data electrode driving voltage in an address period for selecting discharge cells, according to an exemplary embodiment of the present invention.

FIG. 4 illustrates a driving circuit of a data electrode according to an exemplary embodiment of the present invention. FIG. 5 illustrates a data electrode driving voltage V_Dm according to a logic level of a signal illustrated in FIG. 4. FIG. 6 illustrates an energy recovery enable signal ENerc, an address driving signal Sa and the data electrode driving voltage V_Dm in an address period for selecting discharge cells. In particular, in FIG. 6, ENerc represents the energy recovery enable signal illustrated in FIG. 4, Sa represents the address driving signal illustrated in FIG. 4, V_Dm_3*a* represents the data electrode driving voltage illustrated in FIG. 3*a*, and V_Dm_4 represents the data electrode driving voltage illustrated in FIG. 4. Hereinafter, the driving circuit of a data electrode according to the present embodiment will be described with reference to FIGS. 4 through 6.

In FIG. 4, the driving circuit of a data electrode includes an ERC 410, a voltage applying unit 420 and a data electrode driving unit 430. The energy recovery circuit 410 includes a resonance inductor Lerc, a storage capacitor Cerc, and a recovery switch SWerc responsive to the energy recovery enable signal ENerc. The voltage applying unit 420 includes an address voltage switch SWa transmitting an address voltage Va to a node Na. In FIG. 4, the data electrode driving unit 430 includes a first driving transistor PM that transmits an address driving signal Sa to an output node No in response to a first driving signal PD, a second driving transistor NM that transmits a reference voltage Vg to the output node No in response to a second driving signal ND, a drive controlling unit 432 that outputs the first driving signal PD and the second driving signal ND, a first memory MEM1 that outputs a present data signal Data 1, and a second memory MEM2 that outputs a previous data signal Data 2. A comparison unit COMP 436 and a level shifter SHFT 434 which are included in the drive controlling unit 432 will be described hereinbelow with reference to FIGS. 8 and 9. The data electrode driving voltage V_Dm output by the output node No of the data electrode driving unit 430 is applied to a data electrode Dm.

In FIG. 4, a data signal Data is output as the present data signal Data 1 to the drive controlling unit 432 via the first memory MEM 1. In addition, the data signal Data is output as the previous data signal Data 2 to the drive controlling unit 432 via the first memory MEM 1 and the second memory MEM2.

In FIG. 4, while the first driving transistor PM is a p-type MOSFET, and the second driving transistor NM is an n-type MOSFET, those skilled in the art can appreciate that other types of transistors which perform similar functions can be used.

The drive controlling unit 432 compares the previous data signal Data2 with the present data signal Data1 in response to the energy recovery enable signal ENerc, and then outputs the first driving signal PD and the second driving signal ND, which correspond to the comparison result. In particular, when the energy recovery enable signal ENerc is enabled, the drive controlling unit 432 outputs the first driving signal PD and the second driving signal ND, which correspond to the comparison result between the previous data signal Data 2 and the present data signal Data 1. When the energy recovery enable signal ENerc is disabled, the drive controlling unit 432 outputs the first driving signal PD and the second driving signal ND, which correspond to a logic level of the present data signal Data 1.

First, a period in which the energy recovery enable signal ENerc is disabled, that is, a data applying period (e.g., TD12, TD22, TD32, TD42 or TD52 as shown in FIG. 6) will now be described. When a logic level of the energy recovery enable signal ENerc is low, a logic level of the first driving signal PD and a logic level of the second driving signal ND are determined according to a logic level of the present data signal Data 1, regardless of a logic level of the previous data signal Data 2. For example, like in the case of periods E and F illustrated in FIG. 5, when the logic level of the present data signal Data 1 is high, the second driving transistor NM is turned off and the address voltage switch SWa and the first driving transistor PM are turned on, in the data applying period (TD12, TD22, TD32 or TD52 as shown in FIG. 6). Thus, the address voltage Va is applied as the data electrode driving voltage V_Dm to the data electrode Dm. In addition, like in the case of periods G and H, when the logic level of the present data signal Data 1 is low, the second driving transistor NM is turned on and the first driving transistor PM is turned off, in the fourth data applying period TD42 as shown in FIG. 6. Thus, the reference voltage Vg is applied as the data electrode driving voltage V_Dm to the data electrode Dm.

Then, a period in which the energy recovery enable signal ENerc is enabled, that is, an energy recovery period (e.g., E12, E23, E34 or E45 in FIG. 6), will be described. When the logic level of the energy recovery enable signal ENerc is high, the logic level of the first driving signal PD and the logic level of the second driving signal ND are determined according to the comparison result between the previous data signal Data 2 and the present data signal Data 1.

Like in the case of periods B and C illustrated in FIG. 5, when the logic level of the previous data signal Data 2 is different from the logic level of the present data signal Data 1, the second driving transistor NM is turned off and the recovery switch SWerc and the first driving transistor PM are turned on in an energy recovery period (E34 or E45 in FIG. 6). During a period C of FIG. 5, which corresponds to a period E34 of FIG. 6, a voltage falling from the address voltage Va is applied to the data electrode Dm. In the period C, electric charges accumulated in a panel capacitor Cpdp are substantially moved to the storage capacitor Cerc via the first driving transistor PM and the resonance inductor Lerc. During a period B of FIG. 5, which corresponds to a period E45 of FIG. 6, a voltage rising to the address voltage Va is applied to the data electrode Dm. In the period B, electric charges accumulated in the storage capacitor Cerc are substantially moved to the panel capacitor Cpdp via the resonance inductor Lerc and the first driving transistor PM.

Like in the case of a period A of FIG. 5, when the logic level of the previous data signal Data 2 is high and the logic level of the present data signal Data 1 is high, both the first driving transistor PM and the second driving transistor NM are turned off in an energy recovery period (E12 or E23 in FIG. 6). Thus, in the period A, the data electrode Dm enters a high impedance state, that is, in a floating state. According to the present embodiment, when the logic level of the previous data signal Data 2 is high and the logic level of the present data signal Data 1 is also high, electric charges accumulated in the panel capacitor Cpdp cannot be moved to the storage capacitor Cerc by turning off the first driving transistor PM, in the energy recovery period (E12 or E23 in FIG. 6).

On the other hand, when the logic level of the previous data signal Data 2 and the logic level of the present data signal Data 1 are both high, if the first driving transistor PM is turned on in the period A, electrical charges are unnecessarily moved between the panel capacitor Cpdp and the storage capacitor Cerc, thereby increasing energy consumption. That is, during the moving of electric charges accumulated in the panel capacitor Cpdp to the storage capacitor Cerc, energy is used. In addition, during the moving of the electric charges that were moved to the storage capacitor Cerc back to the panel capacitor Cpdp, energy is used. As described above, when the logic level of the previous data signal Data 2 is high and the logic level of the present data signal Data 1 is also high, it is not necessary to move electric charges from the panel capacitor Cpdp to the storage capacitor Cerc or to move the electric charges from the storage capacitor Cerc back to the panel capacitor Cpdp in an energy recovery period.

According to the present embodiment, when the logic level of the previous data signal Data 2 and the logic level of the present data signal Data 1 are both high, electric charges can be prevented from being unnecessarily moved by turning off the first driving transistor PM, in the energy recovery period (E12 or E23 in FIG. 6). Electric charges are prevented from being unnecessarily moved in an energy recovery period, thereby reducing energy consumption and overcoming the thermal issue in an address period.

In FIG. 6, when the data electrode driving voltage V_Dm_3*a* is compared with the data electrode driving voltage V_Dm_4, it can be seen that the data electrode driving voltage V_Dm_3*a* is the same as the data electrode driving voltage V_Dm_4 during a period TD12, a period TD22, a period TD32, a period E34, a period TD42, a period E45 and a period TD52; but different during a period E12 and a period E23. As predicted from the data electrode driving voltage V_Dm_3*a* illustrated in FIG. 6, since a comparison between a previous data signal and a present data signal is not performed in the driving circuit of FIG. 3A, when the logic level of the previous data signal and the logic level of the present data signal are both high, unnecessary swing of the data electrode driving voltage V_Dm occurs in an energy recovery period. However, as seen from the data electrode driving voltage V_Dm_4 illustrated in FIG. 6, when the logic level of the previous data signal Data 2 and the logic level of the present data signal Data 1 are both high in the driving circuit of FIG. 4, unnecessary swing of the data electrode driving voltage V_Dm is minimized in the energy recovery period (E12 or E23 in FIG. 6).

Like in the case of a period D of FIG. 5, when the logic level of the previous data signal Data 2 is low and the logic level of the present data signal Data 1 is low (not shown in FIG. 6), the first driving transistor PM is turned off and the second driving transistor NM is turned on in an energy recovery period. In the energy recovery period, since the data electrode driving voltage V_Dm is maintained at the reference voltage Vg, energy is not unnecessarily used. When the logic level of the previous data signal Data 2 and the logic level of the present data signal Data 1 are both low, the first driving transistor PM and the second driving transistor NM may both be turned off in an energy recovery period.

Figure 7:
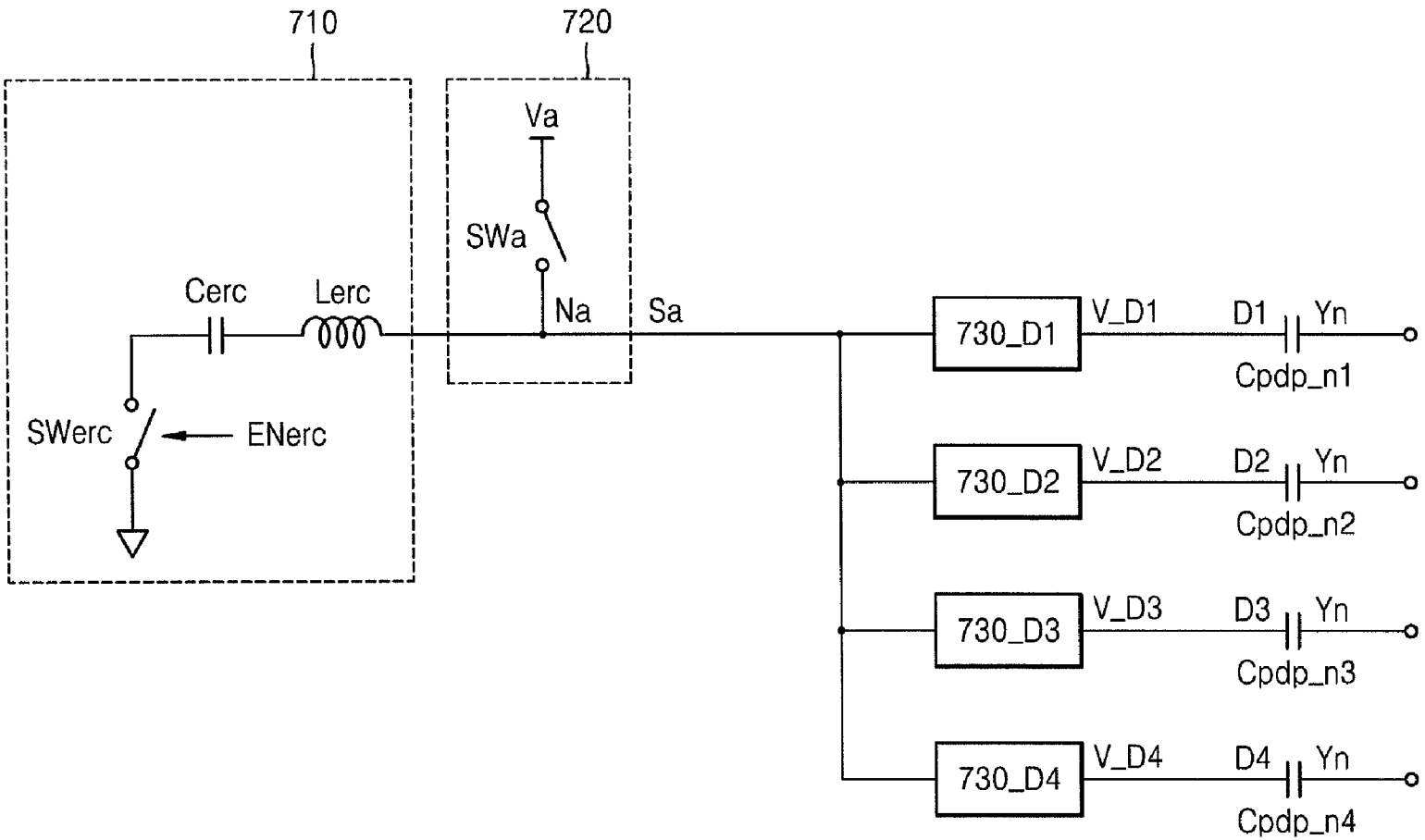
FIG. 7 illustrates a driving circuit of a data electrode including first through fourth data electrode driving units, according to an exemplary embodiment of the present invention.

FIG. 7 illustrates a driving circuit of a data electrode including first through fourth data electrode driving units 730_D1, 730_D2, 730_D3, 730_D4, according to an exemplary embodiment of the present invention.

In FIG. 7, in addition to an ERC 710 and a voltage applying unit 720, the first data electrode driving unit 730_D1 that applies a first data electrode driving voltage V_D1 to a first data electrode D1, the second data electrode driving unit 730_D2 that applies a second data electrode driving voltage V_D2 to a second data electrode D2, the third data electrode driving unit 730_D3 that applies a third data electrode driving voltage V_D3 to a third data electrode D3, and the fourth data electrode driving unit 730_D4 that applies a fourth data electrode driving unit V_D4 to a fourth data electrode D4 are further illustrated. Each of the first through fourth data electrode driving units 730_D1, 730_D2, 730_D3, 730_D4 corresponds to the data electrode driving unit 430 illustrated in FIG. 4. In FIG. 7, the driving circuit of a data electrode also includes a panel capacitor Cpdp_n1 of a discharge cell Cn1 formed at an intersection between a scan electrode Yn and the first data electrode D1, a panel capacitor Cpdp_n2 of a discharge cell Cn2 formed at an intersection between the scan electrode Yn and the second data electrode D2, a panel capacitor Cpdp_n3 of a discharge cell Cn3 formed at an intersection between the scan electrode Yn and the third data electrode D3, and a panel capacitor Cpdp_n4 of a discharge cell Cn4 formed at an intersection between the scan electrode Yn and the fourth data electrode D4.

As illustrated in FIG. 7, the one ERC 710 and the one voltage applying unit 720 may supply the address driving signal Sa to the four data electrode driving units 730_D1, 730_D2, 730_D3, 730_D4. As illustrated in FIG. 6, the address driving signal Sa is maintained at the address voltage Va during a period in which the energy recovery enable signal ENerc is disabled. In addition, the address driving signal Sa falls from the address voltage Va or rises to the address voltage Va during a period in which the energy recovery enable signal ENerc is enabled.

Figure 8:
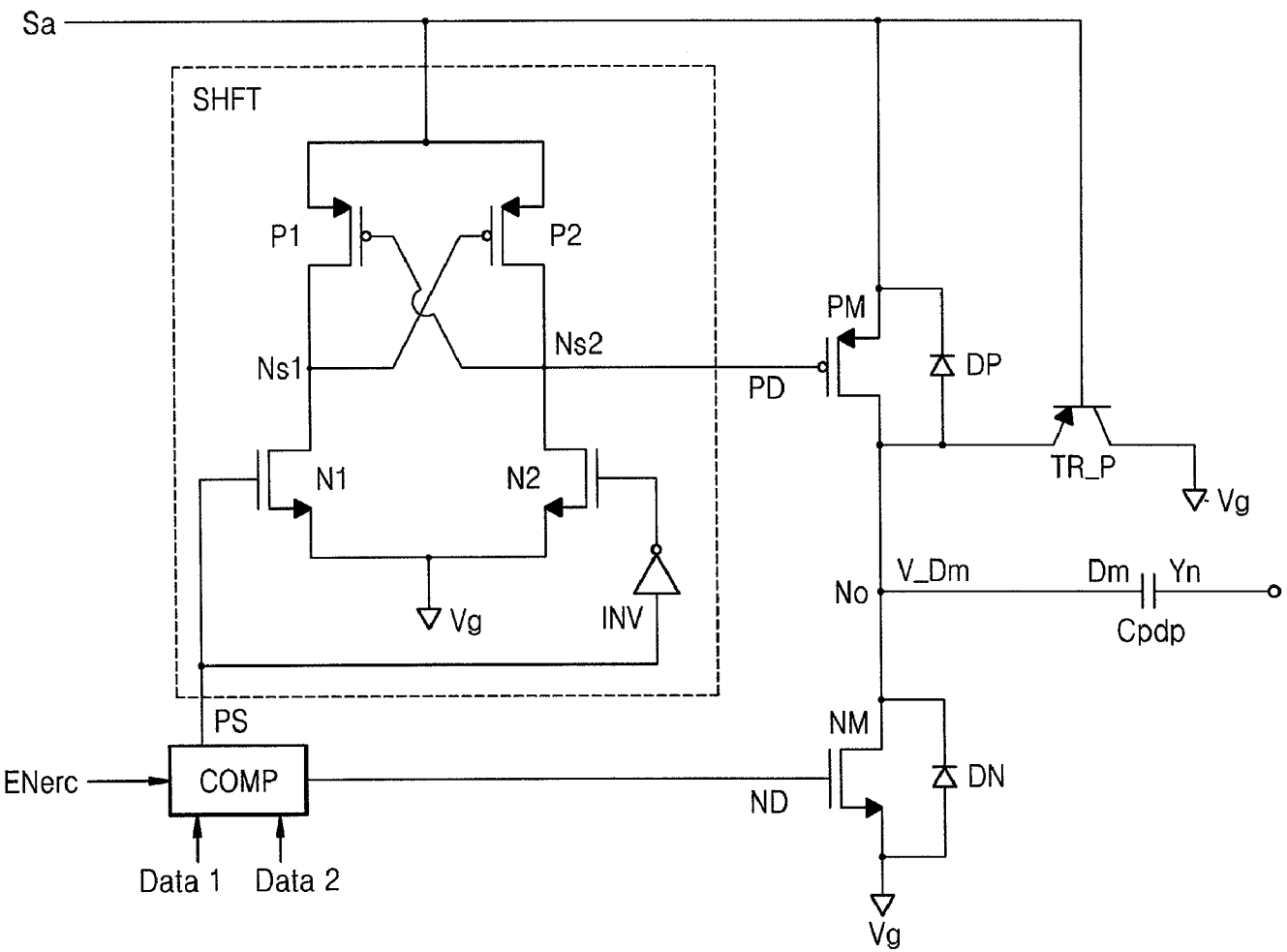
FIG. 8 illustrates in more detail a comparison unit, a level shifter, a first driving transistor and a second driving transistor of FIG. 4.

FIG. 8 illustrates the comparison unit COMP, the level shifter SHFT, the first driving transistor PM, and the second driving transistor NM of FIG. 4, in more detail.

The comparison unit COMP compares the previous data signal Data 2 and the present data signal Data 1 in response to the energy recovery enable signal ENerc, and outputs the drive controlling signal PS and the second driving signal ND, which correspond to the comparison result. The level shifter SHFT shifts a voltage level of the drive controlling signal PS and outputs the shifted drive controlling signal as the first driving signal PD. In FIG. 8, the level shifter SHFT includes a first p-type transistor P1, a second p-type transistor P2, a first n-type transistor N1, a second n-type transistor N2 and an inverter INV. The operation of the level shifter will be described below in more detail with reference to SHFT' of FIG. 9.

As seen in FIG. 8, a diode DP, attached to the first driving transistor PM, is formed together with the first driving transistor PM during an operation of forming the first driving transistor PM. Likewise, a diode DN, attached to the second driving transistor NM, is formed together with the second driving transistor NM during an operation of forming the second driving transistor NM.

In FIG. 8, a parasitic transistor TR_P that may be formed during the forming of the first driving transistor PM is illustrated. Since a charge leakage path is formed from the output node No to the reference voltage Vg through a parasitic transistor TR_P, a part of the electric charges accumulated in the panel capacitor Cpdp leaks through the parasitic transistor TR_P. Since the charge leakage reduces energy recovery efficiency, there is a need to prevent electric charges from leaking through the parasitic transistor TR_P.

Figure 9:
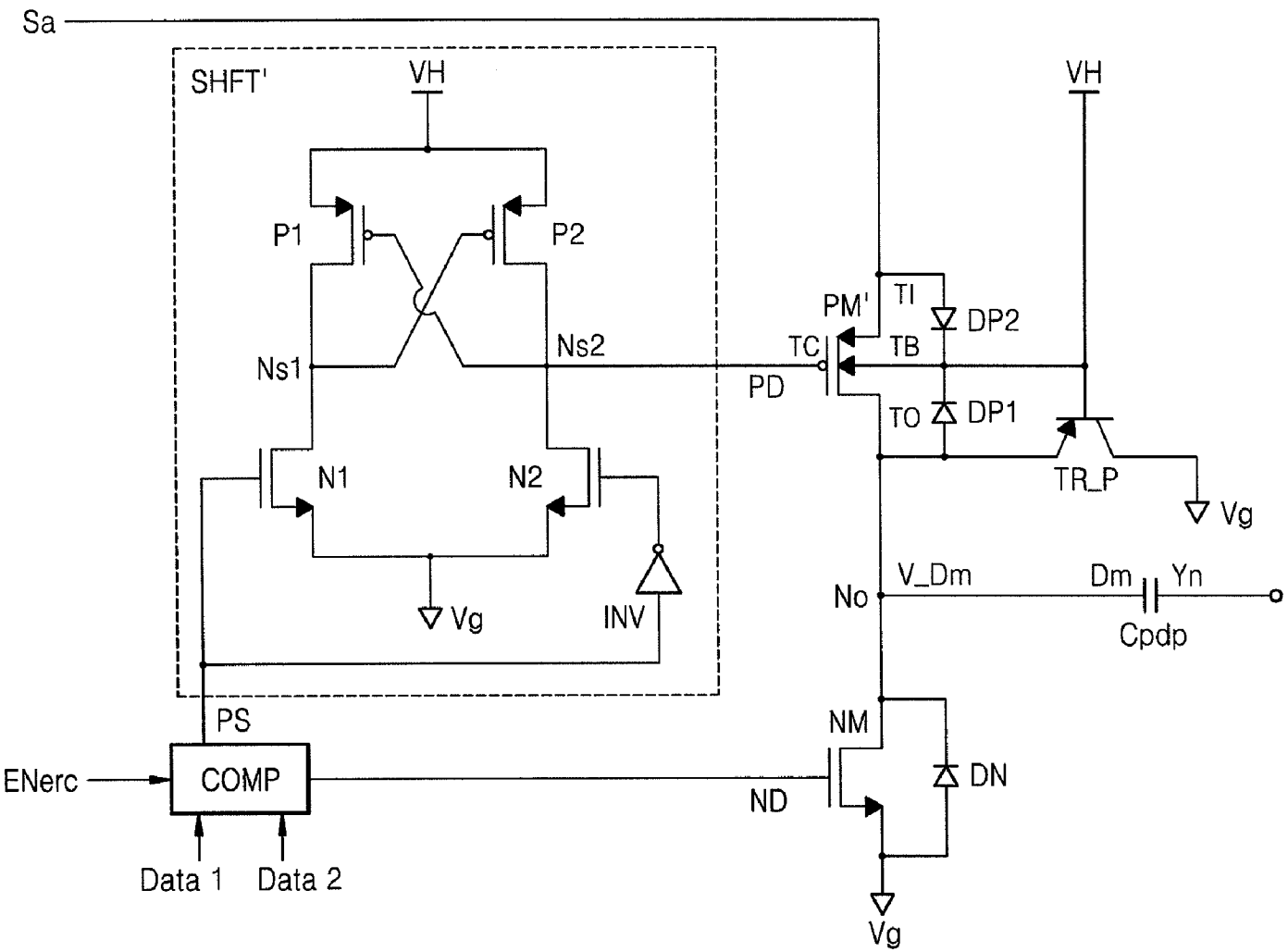
FIG. 9 illustrates an improved level shifter and an improved first driving transistor, according to an exemplary embodiment of the present invention.

FIG. 9 illustrates an improved level shifter SHIFT' and an improved first driving transistor PM', according to an exemplary embodiment of the present invention.

In FIG. 8, the address driving signal Sa is supplied to a controlling terminal of the parasitic transistor TR_P. However, in FIG. 9, a fixed power voltage VH is applied to a controlling terminal of a parasitic transistor TR_P. That is, in FIG. 9, the fixed power voltage VH is maintained in a fixed high voltage level instead of the address driving signal Sa. In FIG. 9, since the parasitic transistor TR_P is a p-type bipolar transistor, when the fixed power voltage VH is applied to the controlling terminal of the parasitic transistor TR_P, the parasitic transistor TR_P is always turned off. Thus, electric charges can be prevented from leaking through a p-type parasitic transistor of which an input terminal is connected to the output node No and of which an output terminal is connected to the reference voltage Vg.

In FIG. 9, the first driving transistor PM' is a p-type MOSFET. In particular, the first driving transistor PM' includes an input terminal TI that receives the address driving signal Sa, an output terminal TO connected to the output node, a controlling terminal TC receiving the first driving signal PD, and a body terminal TB connected to the fixed power voltage VH.

As illustrated in FIG. 9, the controlling terminal of the parasitic transistor TR_P is connected to the body terminal TB of the first driving transistor PM' during forming of the MOSFET. Generally, a body terminal TB of a MOSFET is connected to an input terminal TI of the MOSFET. However, in FIG. 9, to apply the fixed power voltage VH, instead of the address driving signal Sa, to the controlling terminal of the parasitic transistor TR_P, the body terminal TB of the MOSFET is isolated from the input terminal TI of the MOSFET.

A first diode DPI is disposed between the output terminal TO of the first driving transistor PM' and the body terminal TB of the first driving transistor PM', and a second diode DP2 is disposed between the input terminal TI of the first driving transistor PM' and the body terminal TB of the first driving transistor PM'. As illustrated in FIG. 9, a positive terminal of the first diode DPI is connected to the output terminal TO of the first driving transistor PM', and a negative terminal of the first diode DPI is connected to the body terminal TB of the first driving transistor PM'. A positive terminal of the second diode DP2 is connected to the input terminal TI of the first driving transistor PM', and a negative terminal of the second diode DP2 is connected to the body terminal TB of the first driving transistor PM'. Due to the first diode DPI and the second diode DP2, current flow between the body terminal TB of the first driving transistor PM', and the input terminal TI or the output terminal TO thereof can be controlled.

In FIG. 9, the level shifter SHFT' includes a first p-type transistor P1, a second p-type transistor P2, a first n-type transistor N1, a second n-type transistor N2 and an inverter INV. An input terminal of the first p-type transistor P1 is connected to the fixed power voltage VH, an output terminal of the first p-type transistor P1 is connected to a first node Ns1, and a controlling terminal of the first p-type transistor P1 is connected to a second node Ns2. An input terminal of the second p-type transistor P2 is connected to the fixed power voltage VH, an output terminal of the second p-type transistor P2 is connected to the second node Ns2, and a controlling terminal of the second p-type transistor P2 is connected to the first node Ns1. An input terminal of the first n-type transistor N1 is connected to the first node Ns1, an output terminal of the first n-type transistor N1 is connected to the reference voltage Vg, and a controlling terminal of the first n-type transistor N1 receives a drive controlling signal PS. An input terminal of the second n-type transistor N2 is connected to the second node Ns2, an output terminal of the second n-type transistor N2 is connected to the reference voltage Vg, and a controlling terminal of the second n-type transistor N2 is connected to the inverter INV. The inverter INV inverts a logic level of the drive controlling signal PS and outputs the inverted drive controlling signal to the controlling terminal of the second n-type transistor N2.

When the logic level of the drive controlling signal PS, which is output by the comparison unit COMP, is high, since the first n-type transistor N1 and the second p-type transistor P2 are turned on, a voltage level of the first driving signal PD, which is output by the second node Ns2, is approximately the same as a voltage level of the fixed power voltage VH. The first driving signal PD, maintained in a fixed high voltage level, can completely turn off the first driving transistor PM'. Thus, when a logic level of the previous data signal Data 2 and a logic level of the present data signal Data 1 are both high, the first driving transistor PM' is completely turned off, in the energy recovery period (E12 or E23 in FIG. 6), thereby completely preventing electrical charges from being unnecessarily moved.

On the other hand, since the second p-type transistor P2 of the level shifter SHIFT, as illustrated in FIG. 8, is connected to the address driving signal Sa, when the second p-type transistor P2 is turned on, the first driving signal PD which swings like the address driving signal Sa illustrated in FIG. 6 is input to the controlling terminal of the first driving transistor PM. When the logic level of the previous data signal Data 2 and the logic level of the present data signal Data 1 are both high, the first driving signal PD cannot completely turn off the first driving transistor PM, in the energy recovery period (E12 or E23 in FIG. 6). From this point of view, in the level shifter SHFT', the input terminal of the second p-type transistor P2 may be connected in an exemplary embodiment to the fixed power voltage VH, as illustrated in FIG. 9.

Figure 10:
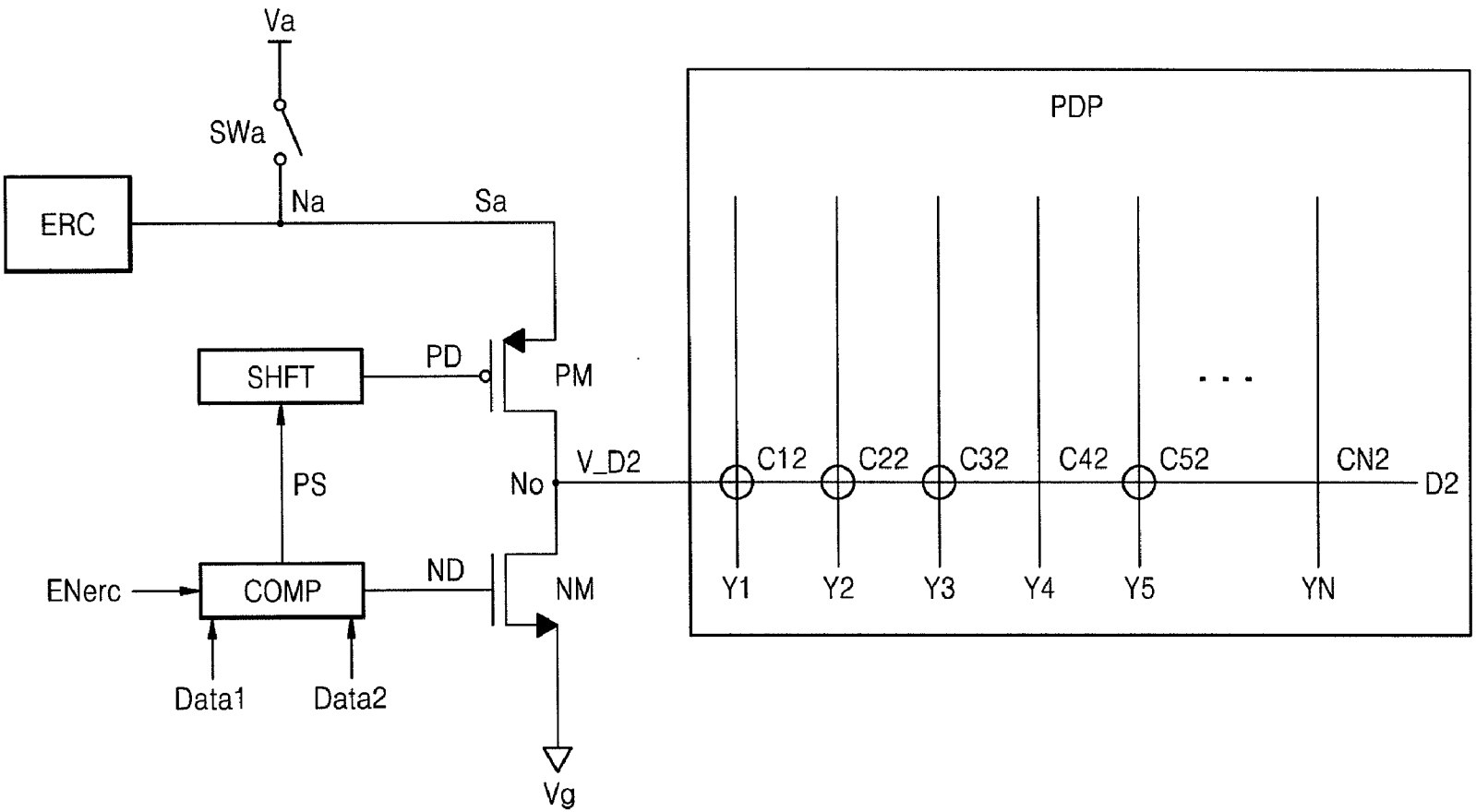
FIG. 10 is a diagram for explaining an operation of driving a data electrode, according to an exemplary embodiment of the present invention.

FIG. 10 is a diagram for explaining an operation of driving a data electrode D2, according to an exemplary embodiment of the present invention. A PDP is illustrated in addition to a driving circuit of the data electrode D2, which corresponds to the driving circuit of a data electrode of FIG. 4. A data electrode driving voltage V_D2, output by the output node No, is applied to the data electrode D2. In the PDP, a first discharge cell C12 through an $N_{th}$ discharge cell CN2 are connected to the data electrode D2. When an $n_{th}$ data signal related to an $n_{th}$ discharge cell Cn2 corresponds to a previous data signal Data2, an $n+1_{th}$ data signal related to an $n+1_{th}$ discharge cell C(n+1)2 corresponds to a present data signal Data 1.

First, an address period for selecting the discharge cells C12 through CN2 is divided into data applying periods (e.g., the first data applying period TD12 for the first discharge cell C12, the second data applying period TD22 for the second discharge cell C22, the third data applying period TD32 for the third discharge cell C32, the fourth data applying period TD42 for the fourth discharge cell C42, the fifth data applying period TD52 for the fifth discharge cell C52, . . . and an $N_{th}$ data applying period TDN2 for an N discharge cell CN2, as shown for the data electrode driving voltage V_Dm_4 of FIG. 6) and energy recovery periods (e.g., the periods E12, E23, E34, E45, . . . , and E(N−1)N, as shown for in the data electrode driving voltage V_Dm_4 of FIG. 6).

In the $n_{th}$ (n is a natural number in the range of 1 to N−1) data applying period TDn2, the address voltage Va or the reference voltage Vg is applied to the data electrode D2 in response to the $n_{th}$ data signal for the $n_{th}$ discharge cell Cn2. In the $n+1_{th}$ data applying period TD(n+1)2, the address voltage Va or the reference voltage Vg is applied to the data electrode D2 in response to the logic level of the $n+1_{th}$ data signal for the $n+1_{th}$ discharge cell C(n+1)2. For example, when a data sequence is "1, 1, 1, 0 and 1", the address voltage Va, the address voltage Va, the address voltage Va, the reference voltage Vg and the address voltage Va are applied to the data electrode D2, in the first data applying period TD12, the second data applying period TD22, the third data applying period TD32, the fourth data applying period TD42 and the fifth data applying period TD52, respectively, as illustrated for the data electrode driving voltage V_Dm_4 of FIG. 6.

In an energy recovery period En(n+1) between the $n_{th}$ data applying period TDn2 and the $n+1_{th}$ data applying period TD(n+1)2, the data electrode D2 may be connected to or isolated from an ERC in response to a comparison result between the $n_{th}$ data signal and the $n+1_{th}$ data signal.

In particular, when the logic level of the $n_{th}$ data signal is high and the logic level of the $n+1_{th}$ data signal is high, the first driving transistor PM is turned off so as to isolate the data electrode D2 from the ERC, in the energy recovery period En(n+1). That is, in the energy recovery period En(n+1), the first driving transistor PM and the second driving transistor NM are both turned off so that the data electrode D2 is in a floating state. When the logic level of the $n_{th}$ data signal is low and the logic level of the $n+1_{th}$ data signal is low, the first driving transistor PM is turned off so as to isolate the data electrode D2 from the ERC, in the energy recovery period En(n+1). When the logic level of the $n_{th}$ data signal is different from the logic level of the $n+1_{th}$ data signal, the first driving transistor PM is turned on so as to connect the data electrode D2 to the ERC, in the energy recovery period En(n+1).

According to the above exemplary embodiments of the present invention, a data electrode is driven according to a comparison result between a previous data signal and a present data signal, thereby reducing unnecessary energy consumption. By reducing the unnecessary energy consumption, the thermal issue can be overcome.

In addition, electric charges can be prevented from leaking through a parasitic transistor formed adjacent to a driving transistor.

While exemplary embodiments of the present invention have been particularly shown and described, it will be understood that various changes in form and details may be made therein without departing from the spirit and scope of the following claims.

What is claimed is:

1. A driving circuit of a plasma display panel having a data electrode, the driving circuit comprising:

a drive controlling unit that compares a previous data signal and a present data signal in response to an energy recovery enable signal, and that outputs a first driving signal and a second driving signal which correspond to a comparison result;

a first driving transistor that transmits an address driving signal to an output node connected to the data electrode in response to the first driving signal; and a second driving transistor that transmits a reference voltage to the output node in response to the second driving signal.

2. The driving circuit of claim 1, wherein when a logic level of the previous data signal is high and a logic level of the present data signal is high, the first driving transistor is turned off during a period in which the energy recovery enable signal is enabled.

3. The driving circuit of claim 2, wherein when the logic level of the previous data signal is high and the logic level of the present data signal is high, the second driving transistor is turned off during a period in which the energy recovery enable signal is enabled.

4. The driving circuit of claim 1, wherein when a logic level of the previous data signal is low and a logic level of the present data signal is low, the first driving transistor is turned off during a period in which the energy recovery enable signal is enabled.

5. The driving circuit of claim 4, wherein when the logic level of the previous data signal is low and the logic level of the present data signal is low, the second driving transistor is turned on during a period in which the energy recovery enable signal is enabled.

6. The driving circuit of claim 1, wherein when a logic level of the previous data signal is different from a logic level of the present data signal, the first driving transistor is turned on and the second driving transistor is turned off during a period in which the energy recovery enable signal is enabled.

7. The driving circuit of claim 1, wherein the address driving signal is maintained at an address voltage during a period in which the energy recovery enable signal is disabled, and wherein the address driving signal falls from the address voltage or rises to the address voltage during a period in which the energy recovery enable signal is enabled.

8. The driving circuit of claim 1, wherein when a first discharge cell through an $N_{th}$ discharge cell are connected to the data electrode, the previous data signal is a data signal for an $n_{th}$ discharge cell and the present data signal is a data signal for an $n+1_{th}$ discharge cell, n being a natural number in the range of 1 to N−1.

9. The driving circuit of claim 1, wherein the drive controlling unit comprises:

a comparison unit that compares the previous data signal and the present data signal in response to the energy recovery enable signal, and that outputs a drive controlling signal and the second driving signal which correspond to the comparison result; and a level shifter that shifts a voltage level of the drive controlling signal and that outputs a shifted drive controlling signal as the first driving signal.

10. The driving circuit of claim 9, wherein the level shifter comprises:

a first p-type transistor having an input terminal connected to a fixed power voltage, an output terminal connected to a first node and a controlling terminal connected to a second node;

a second p-type transistor having an input terminal connected to the fixed power voltage, an output terminal connected to the second node and a controlling terminal connected to the first node;

a first n-type transistor having an input terminal connected to the first node, an output terminal connected to a reference voltage and a controlling terminal receiving the drive controlling signal;

a second n-type transistor having an input terminal connected to the second node and an output terminal connected to the reference voltage; and an inverter that inverts a logic level of the drive controlling signal and that outputs the inverted drive controlling signal to a controlling terminal of the second n-type transistor.

11. The driving circuit of claim 10, wherein the first driving signal output from the second node is input to a controlling terminal of the first driving transistor.

12. The driving circuit of claim 1, wherein the first driving transistor is a p-type metal oxide semiconductor field-effect transistor.

13. The driving circuit of claim 12, wherein the first driving transistor comprises:

an input terminal that receives the address driving signal;

an output terminal connected to the output node;

a controlling terminal that receives the first driving signal; and a body terminal connected to a fixed power voltage.

14. The driving circuit of claim 13, further comprising:

a first diode having a positive terminal connected to the output terminal of the first driving transistor and a negative terminal connected to the body terminal of the first driving transistor; and a second diode having a positive terminal connected to the input terminal of the first driving transistor and a negative terminal connected to the body terminal of the first driving transistor.

15. The driving circuit of claim 13, wherein when a charge leakage path is formed from the output node to a reference voltage through a p-type parasitic transistor having an input terminal connected to the output node and an output terminal connected to the reference voltage, the fixed power voltage is applied to a controlling terminal of the p-type parasitic transistor.

* * * * *